US006281020B1

(12) United States Patent
Usui

(10) Patent No.: US 6,281,020 B1
(45) **Date of Patent: *Aug. 28, 2001**

(54) METHOD OF TESTING CLEANNESS OF INNER SURFACES OF THE PARTS OF A FUEL INJECTION SYSTEM

(75) Inventor: Masayoshi Usui, Numazu (JP)

(73) Assignee: Usui Kokusai Sangyo Kaisha Limited (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/872,309

(22) Filed: Jun. 10, 1997

(30) Foreign Application Priority Data

Jun. 17, 1996 (JP) ..... 8-177073

(51) Int. Cl.[7] ..... F02M 65/00

(52) U.S. Cl. ..... 436/175; 73/60.11; 73/119 A; 134/113; 134/169 A; 422/101; 436/177

(58) Field of Search ..... 436/177, 178, 436/174, 175; 422/101; 73/60.11, 119 A, 119 R; 134/169 A, 22.11, 22.12, 22.13, 22.14, 113

(56) References Cited

U.S. PATENT DOCUMENTS 3,595,252 * 7/1971 Conte .
3,936,659 * 2/1976 Mainord .
4,714,998 * 12/1987 Bussey et al. .
4,782,693 * 11/1988 Heyer et al. .
4,804,005 * 2/1989 Hartopp .
4,909,207 * 3/1990 Takano et al. .
5,289,837 * 3/1994 Betancourt .
5,339,845 * 8/1994 Huddas .
5,415,190 * 5/1995 Ionescu .
5,464,477 * 11/1995 Awad .
5,516,370 * 5/1996 Karnauchow et al. .
5,693,874 * 12/1997 De la Cruz et al. .
5,698,043 * 12/1997 Acevedo .

* cited by examiner

*Primary Examiner*—Jan Ludlow
(74) *Attorney, Agent, or Firm*—Anthony J. Casella; Gerald E. Hespos; Michael J. Porco

(57) ABSTRACT

The present invention provides a method of testing the cleanness of the inner surface of a high-pressure fuel injection pipe in which the cleanness of the inner surface of a high-pressure fuel injection pipe can be accurately measured with less variation and high reproducibility. In testing the cleanness of the inner surface of a high-pressure fuel injection pipe based on foreign particles collected by a filter for filtering a measuring liquid obtained by washing the inner circumferential surface of the high-pressure fuel injection pipe, at least the part of a group of measuring apparatuses used for testing the cleanness of the inner surface of the high-pressure fuel injection pipe that is in contact with the measuring liquid is washed using a washing solution comprising a solvent for dissolving foreign particles prior to the testing of cleanness.

14 Claims, 1 Drawing Sheet

METHOD OF TESTING CLEANNESS OF INNER SURFACES OF THE PARTS OF A FUEL INJECTION SYSTEM

BACKGROUND OF THE INVENTION

1. Field of the Invention

The present invention relates to a method of testing the cleanness of the inner surfaces of the parts of a fuel injection system and the parts of a fuel pressure accumulating system, both the systems of which constructing a diesel engine fuel injection system and having contacting parts with a fuel, and the parts of the fuel injection system of which being such as a fuel injection pump, fuel injection nozzle, and fuel injection pipe and the parts of the fuel accumulating system of which being such as a common rail, injection pump, injection nozzle, injection pipe, flow limiter, pressure regulator and feed pipe.

2. Description of the Prior Art

Recently, there is an accelerating trend toward an increase in the pressure of fuel to be supplied to a high pressure fuel injection pipe used typically as the parts of a fuel injection system for a diesel engine as a measure for reducing NOx and black smoke, and this has resulted in a need for fuel injection for an injection period of 1 to 2 msec., at a maximum flow rate of 50 m/sec. and at a high internal pressure in the range from 60 to 1500 bar (peak value).

Such a change in market demands is accompanied by an increased possibility of clogging of an injection nozzle caused by foreign particles such as metal particles which have stuck to the inner surface of a high-pressure fuel injection pipe after floating in the air or entering from the outside, and this can cause a faulty operation of a diesel engine or damage to a fuel pump. Thus, it is an important problem to be solved to improve the cleanness of the inner surface of a high-pressure fuel injection pipe in order to prevent this.

In order to improve the cleanness of the inner surface of a high-pressure fuel injection pipe, however, it is necessary to first establish a method of measurement which makes it possible to properly determine the level of cleanness of a product. Under such circumstances, various methods of testing the cleanness of the inner surface of a high-pressure fuel injection pipe such as methods using a injection pump, hand tester methods, syringe and improved syringe have been proposed by the Society of Automotive Engineers, foreign manufacturers and ISO committees.

However, among the testing methods proposed in the past, both of the injection pump method and hand tester method are unsuitable for the evaluation of a high quality high-pressure fuel injection pipe belonging to the P-class or higher which inherently has less foreign particles because such methods are vulnerable to noises from a pump or nozzle. Further, both of the syringe method and improved syringe method have had a problem in that the extraction of foreign particles present in a high-pressure fuel injection pipe tends to be unsatisfactory, although there is less noise from the measuring system.

Thus, test results obtained according to the testing methods proposed in the past have a low level of reproducibility and also includes variation. As a result, no particular method has been established and put in use yet.

SUMMARY OF THE INVENTION

The inventors have found that variation or the like in the results of cleanness measurement obtained by the various tests on the cleanness of the inner surface of the parts of the fuel injection system as described above is closely related to contamination due to foreign particles in tools and liquids used for testing and conceived that a standardized method of testing the cleanness of the inner surface of the parts of the fuel injection system can be provided by making an improvement on this point.

It is therefore an object of the present invention to provide a method of testing the cleanness of the inner surface of the parts of the fuel injection system which results in less variation in test results and which allows accurate measurement with high reproducibility.

Specifically, according to the present invention, there is provided a method of testing the cleanness of the inner surface of the parts of the fuel injection system characterized in that in testing the cleanness of the inner surface of the parts of the fuel injection system is tested based on foreign particles collected by a filter for filtering a measurement liquid obtained by washing the inner circumferential surface of the parts of the fuel injection system, at least the part of a group of measuring apparatuses used for testing the cleanness of the inner surface of the parts of the fuel injection system that is in contact with the measuring liquid is washed using a washing solution comprising a solvent for dissolving foreign particles prior to the testing of cleanness.

Further, in testing the cleanness of the inner surface of the parts of the fuel injection system, it is preferable to wash the part of the tools used for preparing the measuring liquid for the testing of the cleanness of the inner surface of the parts of the fuel injection system that is in contact with the measuring liquid is washed in advance using the washing solution comprising a solvent for dissolving foreign particles.

In addition, the solvent for dissolving foreign particles is preferably an acid, alkali or organic solvent, and such cleaning utilizing the solvent for dissolving foreign particles is preferably repeated a plurality of times utilizing different kinds of solvents or the same kind of solvent.

DETAILED DESCRIPTION OF THE INVENTION

The present invention will now be described with reference to the drawings.

Figure 1:
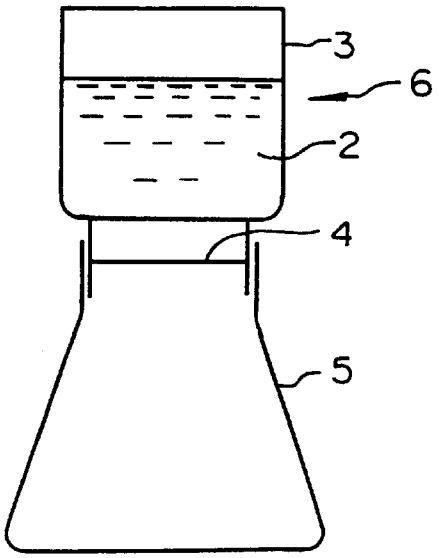
FIG. 1 is a front view of a filtering apparatus.
Figure 2:
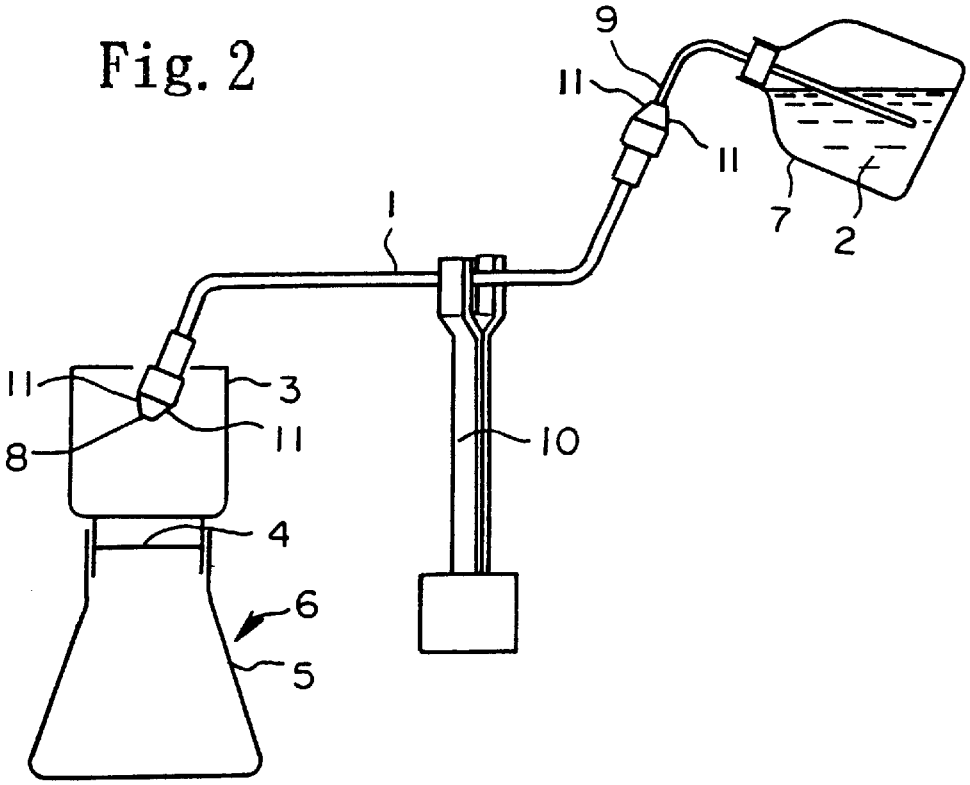
FIG. 2 illustrates the arrangement of each part of a measuring apparatus.

In FIGS. 1 and 2, 1 designates a metal sample to be tested having a large wall thickness and a small diameter as the parts of the fuel injection system; 2 designates a measuring liquid that flows on the inner circumferential surface of the sample; 3 designates a funnel for containing the measuring liquid 2; 4 designates a filter attached to an opening at a lower part of the funnel; 5 designates a glass container for containing filtered measuring liquid; 6 designates a filtering apparatus constituted by the funnel 3, membrane filter 4 and glass container 5; 7 designates a washing bin for containing filtered measuring liquid to be used for testing; 8 and 9 respectively designate an exhaust port and an injection port opened on both ends of the parts of the fuel injection system as a sample to be tested; 10 designates a grip for gripping and securing the sample to be tested; and 11 designates the outer circumferential surface of the sample to be tested.

The funnel 3, membrane filter 4, glass container 5 and washing bin 7 are used not only for the measuring liquid 2 but also for washing using a solvent for dissolving foreign particles carried out before cleanness testing and for preparation of the measuring liquid itself.

The present invention is characterized in that the part of the group of measuring apparatuses as described above used for testing the cleanness of the inner surface of the high-pressure fuel injection pipe that is in contact with the measuring liquid or the apparatuses as a whole are washed using a washing solution comprising a solvent for dissolving foreign particles prior to the testing of cleanness. Acid type solvents such as phosphoric acid type solvents and oxalic acid-hydrogen peroxide type solvents are used here for iron type foreign particles. Specifically, a product "CPL-200" manufactured by Mitsubishi Gas Chemical Co., Inc. may be cited as an example which is used at a solvent temperature in the range from 10 to 40° C.

For foreign particles comprising aluminum type metal particles, alkali type solvents such as NaOH may be used at a solvent temperature in the range from 10 to 80° C. Further, acid type solvents such as nitric acid are effective for organic foreign particles in addition to the above-described acid type solvents, and alcohol such as methanol and butanol and organic solvents such as methylene chloride and normal hexane may be used for fats and fatty oils, each of such solvents being used at a solvent temperature in the range from 10 to 40° C.

The above-described acid, alkali and organic solvents may be used by mixing them appropriately as needed provided that the mixed solvents are of the same type, and different types of solvents for dissolving foreign particles may be used alternately when cleaning is repeated a plurality of times. For example, depending on the foreign particles to be cleaned, cleaning may be first performed using an acid type solvent and then using an alkali type solvent. Alternatively, cleaning may be performed using solvents of the same kind, e.g., cleaning may be first performed using a phosphoric acid type solvent and then using an oxalic acid-hydrogen peroxide type solvent.

Various conventional known methods may be employed as needed including injection of a washing solution at a high pressure and immersion in a washing solution.

By washing the group of measuring apparatuses using a solvent for dissolving foreign particles as described above, foreign particles such as metal particles, organic substances or fats and fatty oils of a size about 200 to 300 μm or less which have stuck to the measuring apparatuses are dissolved. This prevents the occurrence of errors in measured values due to adhesion of foreign particles during a cleanness test to be carried out later.

EXAMPLE

Example 1

As a sample to be tested 1, a high-pressure fuel injection pipe for a diesel engine was prepared by bending predetermined positions of a metal pipe having an outer diameter of 6.4 mm, an inner diameter of 1.8 mm and a length of 700 mm made of JIS G3455 STS 370.

As a washing solution, a solvent for dissolving foreign particles was prepared by adding 150 V/V per cent nitric acid, 400 V/V per cent sulfuric acid and iron chloride of 50 g per a solution of 1 liter to 400 V/V per cent of phosphoric acid.

Further, the measuring liquid 2 for testing the cleanness of the inner surface of the sample to be tested 1 was prepared in advance by removing impurities in light oil by a filtering apparatus 6 formed by the funnel 3 shown in FIG. 1. a membrane filter 4 having transmission holes of 0.65 μm and made of ester mixed with cellulose, and a glass container 5 for containing light oil filtered by the filter. In doing so, each part that forms the filtering apparatus 6 was separately washed using aceton prior to the process of filtering light oil, was subjected to a washing process, after being dried, for 10 minutes at 23° C. using the solvent for dissolving foreign particles having the above-described composition, washed further using ultrapure water and dried in a clean oven, and was assembled into the filtering apparatus 6 in a clean room.

Next, as shown in FIG. 2, a separate filtering apparatus 6 was provided which was constituted by a funnel 3, a membrane filter 4 having a diameter of 47 mm and transmission holes of 3 μm and made of ester mixed with cellulose, and a glass container 5.

The above-described separate filtering apparatus was also provided by washing each part that forms the filtering apparatus 6 separately using aceton prior to the measurement of the cleanness of the inner surface of the sample to be tested 1, performing a washing process thereon, after drying it, for 10 minutes at 23° C. using the solvent for dissolving foreign particles having the above-described composition, washing further using ultrapure water and drying it in a clean oven, and assembling it into the filtering apparatus 6 in a clean room.

Then, the sample to be tested 1 was fixed by the grip 10 in a state wherein the measuring liquid exhaust port 8 of the high-pressure fuel injection pipe for a diesel engine as the sample to be tested 1 was inserted in the funnel 6 of the filtering apparatus which has been assembled after being washed as described above and wherein the measuring liquid injection port 9 of the sample to be tested 1 was positioned above the position where the measuring liquid exhaust port 8 was inserted.

The entire amount of the measuring liquid 1 thus prepared which was ten times the internal capacity of the sample to be tested 1 contained in the washing bin 7 was injected into the sample to be tested 1, and foreign particles of iron mixed in the measuring liquid 2 exhausted from the measuring liquid exhaust port 8 were captured by the membrane filter 4.

Next, the foreign particles of iron extracted through the cleaning of the inner surface of the sample to be tested 1 and captured by the membrane filter 4 were collected and measured in terms of the shapes, dimensions and quantity thereof.

The result of such a test on the cleanness of the inner surface of the sample to be tested 1 was preferable in that the degree of variation in the results of twenty cycles of test performed on the same lot of products was significantly smaller, i.e., one-third of that resulted from a conventional method of testing in which no washing step utilizing a washing solution comprising a solvent for dissolving foreign particles was included in the fabrication steps.

In this case, the determination was made on criteria for determination of cleanness defined in ISO 4406 and ISO WD12345, 1994.

Example 2

The same process as in Example 1 was carried out except that a washing solution comprising a solvent for dissolving foreign particles utilizing "CPL-200" manufactured by Mitsubishi Gas Chemical Co., Inc. which is mainly composed of an oxalic acid-hydrogen peroxide type solution was used. As a result, accurate results were obtained an in Example 1.

Example 3

The same process as in Example 1 was carried out except that as the solvent for dissolving foreign particles, a washing solution was prepared which consisted of 25 g of oxalic acid, 13 g of hydrogen peroxide, 0.1 g of sulfuric acid, and 1000 ml of distilled water and that the washing process was performed for 40 minutes at 25° C. As a result, accurate results were obtained an in Example 1.

Example 4

The same process as in Example 1 was carried out except that a washing solution was prepared comprising a solvent for dissolving foreign particles consisting of condensed phosphoric acid including 75 per cent $P_2O_5$ of 100 V/V per cent and sulfuric acid of 10 V/V per cent and that the washing process was performed for ten minutes at 200° C. As a result, accurate results including no organic foreign particle were obtained an in Example 1.

Example 5

The same process as in Example 1 was carried out except that as the solvent for dissolving foreign particles, a washing solution consisting of 100 ml of (1+1) nitric acid was used; the sample to be tested 1 was immersed in this washing solution for five minutes; heating process was performed at 80° C. until the amount of the solution was halved; the sample was immersed again in a washing solution obtained by adding 25 ml of nitric acid to 50 ml of (1+1) sulfuric acid; and a heating process was performed until 80° C. was reached where white smoke of sulfuric acid was generated. Accurate values were obtained as in Example 1, as a result of measurement of the shapes, dimensions and quantity of organic substances as foreign particles.

Example 6

The same process as in Example 1 was carried out except that the sample to be tested 1 was immersed for five minutes in a washing solution consisting of 100 ml of (1+1) nitric acid as a solvent for dissolving foreign particles; the washing solution was heated at 80° C. until the amount of the solution was halved; 25 ml of nitric acid was added after cooling of the solution naturally; the sample was further immersed in a washing solution obtained by gradually adding perchloric acid of a concentration of 60 per cent by small amounts for five minutes; and the sample was heated again until 80° C. was reached where white smoke of perchloric acid was generated and then covered by a watch glass. Accurate values were obtained as in Example 1, as a result of measurement of the shapes, dimensions and quantity of organic substances as foreign particles.

Example 7

The same process as in Example 1 was carried out except that as the solvent for dissolving foreign particles, a washing solution consisting of normal hexane of a concentration of 96 per cent and a washing solution consisting of butanol of a concentration of 99 per cent were prepared and that a washing process was performed for ten minutes using each of those washing solutions. As a result, accurate values were obtained in both cases as a result of measurement of fats and fatty oils as foreign particles.

Example 8

The same process as in Example 1 was carried out except that a high-pressure fuel injection pipe for a diesel engine as in Example 1 was provided as the sample to be tested 1 and that a washing process was performed for five minutes at the room temperature using a washing solution consisting of NaOH of a concentration of 10 per cent as the solvent for dissolving foreign particles. Accurate values were obtained as in Example 1, as a result of measurement of the shapes, dimensions and quantity of Al particles as foreign particles.

Example 9

The same process as in Example 1 was carried out except that as the solvent for dissolving foreign particles, a washing solution was used which was obtained by adding 25 g/l of oxalic acid, 13 g/l of hydrogen peroxide and 0.1 g/l of sulfuric acid to 100 ml of (1+1) nitric acid and that the washing process was performed for 30 minutes at 25° C. As a result, accurate results were obtained an in Example 1.

Example 10

The same process as in Example 1 was carried out except that as the solvent for dissolving foreign particles, a washing solution was used which was obtained by adding 25 g/l of hydrofluoric acid and 100 g/l of hydrogen peroxide to distilled water and that the washing process was performed for 3 minutes at the room temperature. As a result, accurate results were obtained an in Example 1.

As described above, according to the present invention, a washing process is performed on measuring apparatuses except locations associated with a sample to be tested prior to a test on cleanness using washing solutions comprising solvents for dissolving foreign particles consisting of acid, alkali or organic solvents, preferably in a plurality of cleaning cycles utilizing different types of solutions or the same kind of solution as described above. Thus, metal particles such as ion and aluminum and foreign particles of organic substances and fats and fatty oils having a size of about 200 to 300 $\mu$m or less are dissolved to allow accurate measurement values to be displayed at a test of cleanness performed later.

As described above, according to the present invention, it is possible to measure the cleanness of the inner surface of a high-pressure fuel injection pipe with less variation and high reproducibility even if the tested sample is a high-pressure fuel injection pipe bent in a predetermined shape and having a configuration that allows piping operation on itself as it is.

Further, the present invention allows a significant reduction in cost and testing steps because no special apparatus is required.

It should be understood that he foregoing description it is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A method for testing cleanness of an inner surface of a part of a fuel injection system, wherein said testing of cleanness includes the steps of washing the inner surface of said part of the fuel injection system with a measuring liquid, filtering the measuring liquid with a filter to remove foreign particles therefrom, and determining the cleanness of the inner surface of said part based on the foreign particles collected by said filter, and wherein tools are provided for preparing said measuring liquid, and wherein the measuring liquid is selectively handled by measuring apparatuses during said testing of cleanness, the improvement comprises the steps of:

washing portions of said measuring apparatuses that come into contact with said measuring liquid using a washing solution comprising a first solvent for dissolving foreign particles prior to the testing of cleanness; and prior to the testing of cleanness, washing the portions of said tools that come into contact with said measuring liquid using a second washing solution comprising a second solvent for dissolving foreign particles prior to the preparation of said measuring liquid;

wherein said first solvent is phosphoric acid and oxalic acid-hydrogen peroxide for dissolving iron or organic foreign particles, caustic soda for dissolving iron foreign particles, or an alcohol for dissolving fats and fatty oils or said second solvent is phosphoric acid and oxalic acid-hydrogen peroxide for dissolving iron or organic foreign particles, caustic soda for dissolving iron foreign particles, or an alcohol for dissolving fats and fatty oils.

2. A method according to claim 1, wherein said step of washing utilizing said first solvent for dissolving foreign particles is repeated a plurality of times utilizing different kinds of solvents.

3. A method according to claim 1, wherein said first solvent is phosphoric acid and oxalic acid-hydrogen peroxide for dissolving iron foreign particles.

4. A method according to claim 1, wherein said first solvent is caustic soda for dissolving aluminum foreign particles.

5. A method according to claim 1, wherein said first solvent is phosphoric acid and oxalic acid-hydrogen peroxide for dissolving organic foreign particles.

6. A method according to claim 1, wherein said first solvent is an alcohol for dissolving fats and fatty oils.

7. A method according to claim 1, wherein said step of washing utilizing the second solvent for dissolving foreign particles is repeated a plurality of times utilizing different kinds of solvents.

8. A method according to claim 1, wherein said second solvent is phosphoric acid and oxalic acid-hydrogen peroxide for dissolving iron foreign particles.

9. A method according to claim 1, wherein said second solvent is caustic soda for dissolving aluminum foreign particles.

10. A method according to claim 1, wherein said second solvent is phosphoric acid and oxalic acid-hydrogen peroxide solvents for dissolving organic foreign particles.

11. A method according to claim 1, wherein said second solvent is alcohol for dissolving fats and fatty oils.

12. A method according to claim 1, wherein said step of washing utilizing said first solvent for dissolving foreign particles is repeated a plurality of times utilizing the same kind of solvent.

13. A method according to claim 1, wherein said step of washing utilizing said second solvent for dissolving foreign particles is repeated a plurality of times utilizing the same kind of solvent.

14. A method for testing cleanliness of an inner surface of a part of a fuel injection system, wherein said method for testing cleanliness consists essentially of the steps of: providing a measuring liquid for washing the inner surface of said part of the fuel injection system; providing tools for preparing said measuring liquid; providing measuring apparatus for selectively handling the measuring liquid during the testing of cleanliness; washing with a first washing solution portions of said measuring apparatus that will come into contact with said measuring liquid, said first washing solution comprising a first solvent for dissolving foreign particles; washing with a second washing solution portions of said tools that will come into contact with said measuring liquid, said second washing solution comprising a second solvent for dissolving foreign particles; preparing the measuring liquid using the washed tools; washing the inner surface of said part of the fuel injection system with the measuring liquid; filtering the measuring liquid with a filter to remove foreign particles therefrom; and determining the cleanliness of the inner surface of said part based on the foreign particles collected by said filter;

wherein said first solvent is phosphoric acid and oxalic acid-hydrogen peroxide for dissolving iron or organic foreign particles, caustic soda for dissolving iron foreign particles, or an alcohol for dissolving fats and fatty oils or said second solvent is phosphoric acid and oxalic acid-hydrogen peroxide for dissolving iron or organic foreign particles, caustic soda for dissolving iron foreign particles, or an alcohol for dissolving fats and fatty oils.

* * * * *